US005729960A

United States Patent [19]

Davis

[11] Patent Number: 5,729,960

[45] Date of Patent: Mar. 24, 1998

[54] ADJUSTABLE ASSEMBLY LINE AND SHIPPING CONTAINER FOR ELECTRONIC BOARD COMPONENTS

[75] Inventor: Thomas E. Davis, DeSoto, Tex.

[73] Assignee: Tenneco Packaging Inc., Evanston, Ill.

[21] Appl. No.: 799,553

[22] Filed: Feb. 13, 1997

[51] Int. Cl.[6] ..... B65B 5/04; B65B 23/00; B65B 23/20; B65B 55/20

[52] U.S. Cl. ..... 53/458; 53/472; 206/454; 206/485; 206/564; 206/453; 229/120.37; 229/122; 229/913

[58] Field of Search ..... 53/458, 472, 473, 53/169, 467, 566, 564, 555; 206/205, 453, 454, 455, 456, 555; 229/118, 120.06, 120.32, 120.37, 122, 913

[56] References Cited

U.S. PATENT DOCUMENTS

| | | | |
|---|---|---|---|
| 2,746,667 | 5/1956 | Murphy | 206/454 X |
| 3,339,722 | 9/1967 | Van Antwerpen | 206/453 |
| 4,025,039 | 5/1977 | Croll et al. | 206/485 X |
| 4,146,127 | 3/1979 | Bayer | 206/485 X |
| 4,592,914 | 6/1986 | Kuchenbecker | 229/122 X |
| 4,653,646 | 3/1987 | Allen et al. | 206/453 X |
| 4,700,844 | 10/1987 | Griffith | 206/453 X |
| 4,706,438 | 11/1987 | Ohlbach | 53/472 X |
| 5,130,106 | 11/1994 | Nakayama et al. | 206/555 X |
| 5,180,075 | 1/1993 | Montalbano | 229/120.32 X |
| 5,553,444 | 9/1996 | Lovecky et al. | 53/472 X |

*Primary Examiner*—Horace M. Culver
*Attorney, Agent, or Firm*—Arnold, White & Durkee

[57] ABSTRACT

A method of using an assembly line and shipping container including the step of first providing the container. The container has an outer shell, a first pad element and a second pad element. The pad elements have an inside surface and an outside surface. Compressible elements are coupled to the outside surfaces of the pad elements. The inside surfaces of the pad elements are oppositely aligned with respect to each other inside the outer shell. The first and second pad elements include a first and a second longitudinal slot respectively, the slots aligned opposite each other. During use, the container is placed on an assembly line having at least one work station. A board component is inserted into the container along the longitudinal slots. The board component is removed from the container at the work station. Work then is performed on the board component. The board component is placed back into the container after performing the work and the board component is shipped inside the container.

14 Claims, 3 Drawing Sheets

ADJUSTABLE ASSEMBLY LINE AND SHIPPING CONTAINER FOR ELECTRONIC BOARD COMPONENTS

BACKGROUND OF THE INVENTION

The present invention relates generally to containers for board elements. More specifically, the present invention is directed to an assembly line and shipping container capable of accommodating and protecting electronic circuit boards of various sizes.

Circuit boards usually comprise an assemblage of electronic elements (such as resistors, capacitors, and computer chips) mounted or printed on a generally planar board of an insulating sheet of material (such as epoxy-bonded fiberglass). The electronic components of circuit boards generally are delicate and are extremely sensitive to currents caused by electrical charges. A static electricity discharge may be sufficient to permanently damage the electronic components of a circuit board. Circuit boards are manufactured in a variety of sizes.

During assembly line manufacturing the boards traditionally are placed in electrically nonconducting plastic tote bins having reciprocal rails. At each work station the boards are removed from the bins by the worker or by a machine which performs work on the board, such as adding components or soldering. After the work is performed, the board is placed back into the tote bins. At the end of each assembly line, the boards are removed from the bins and are either placed in other bins for further processing or are packaged for shipping. The bins are either recycled or returned to the beginning of the assembly line. As circuit boards are manufactured in a variety of dimensions, it often has been necessary to stock different-sized bins.

When a board is ready for transport or shipment to the customer, the board is packaged in a container. Packaging the boards into shipping boxes requires an additional packaging station and additional handling of the boards, thus increasing the risk of damaging the circuit board elements. Different containers and packaging materials usually are necessary to accommodate boards of different sizes.

SUMMARY OF THE INVENTION

The present invention is directed to an assembly line and shipping container for board components and a method for using the container. The container includes an outer shell, a first and a second pad element, and a first and a second compressible element. The pad elements have an inside surface and an outside surface. The inside surfaces of the first and second pad elements include a first and a second longitudinal slot respectively. The first compressible element is coupled to the outside surface of the first pad element and the second compressible element is coupled to the outside surface of the second pad element. The inside surfaces of the pad elements are oppositely aligned with respect to each other inside the outer shell and the slots are aligned opposite each other.

The method of use includes the steps of providing the container and placing the container on an assembly line having at least one work station. A board component is slid into the container along the longitudinal slots. The container and the board component advance along the assembly line, reaching a work station. At the work station, a worker or a machine removes the board component from the container and work is performed on the board component. After the work is completed, the board component is slid into the container. The removal and insertion steps may be repeated at various work stations. When the work at the assembly line is completed, the board component is shipped inside the container.

DETAILED DESCRIPTION OF THE INVENTION

Figure 1:
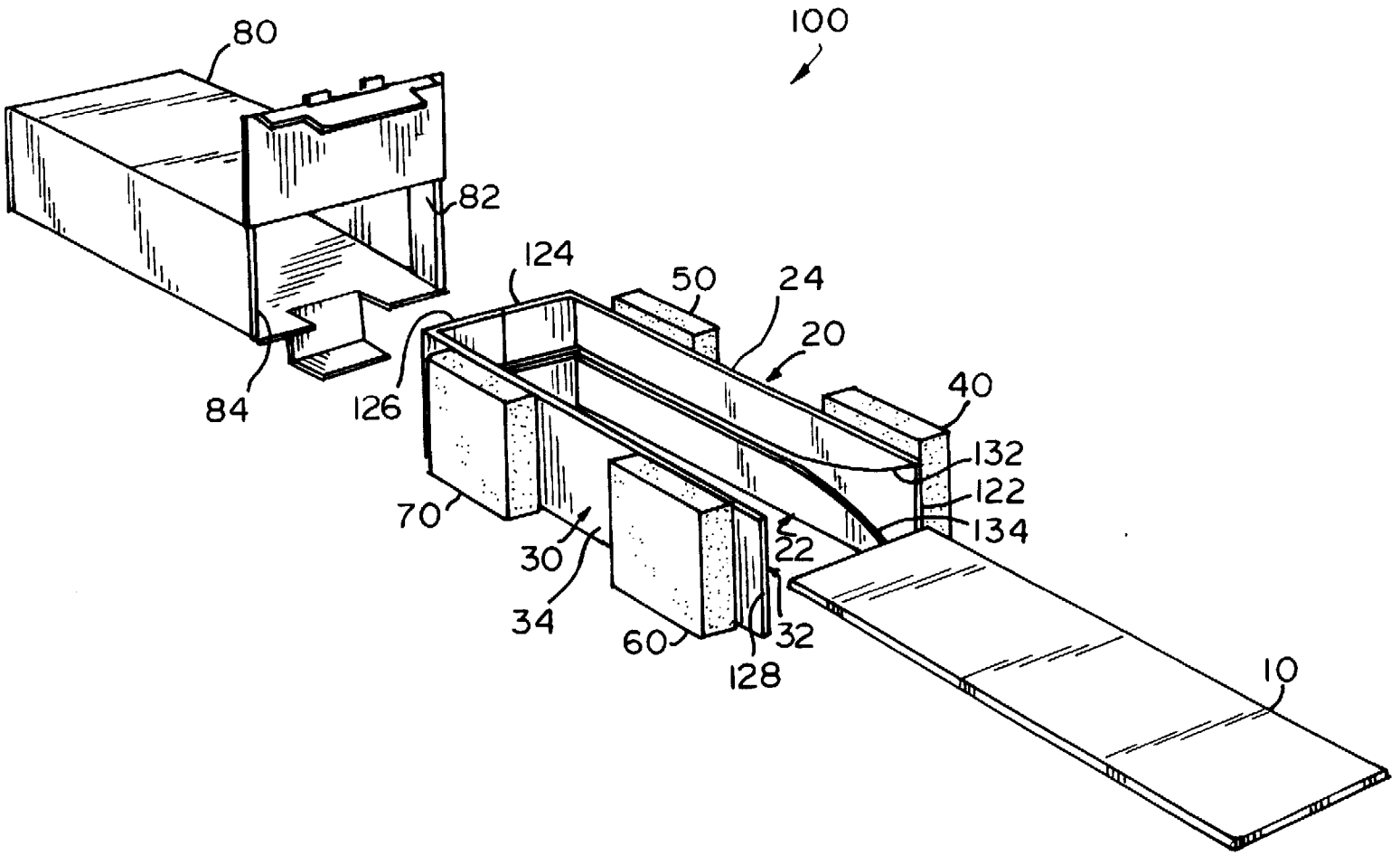
FIG. 1 is an isometric view of a container in accordance with the present invention.

The present invention is directed to a container that may be used both during the assembly process and during the shipping of a board component. The term board component is generally defined as a generally planar component that is suitable to be secured by a slot arrangement. The term board component is intended to include printed circuit boards, breadboards, multilayer boards, peripheral boards, memory boards, and other electronic component boards known in the art. Furthermore, the term is also intended to describe other generally planar structures that may be secured by placing them in a container in accordance with the present invention. FIG. 1 illustrates a board element 10 in position to be slid into a container 100 in accordance with the present invention.

The container 100 includes a first pad element 20 and a second pad element 30. The pad elements 20 and 30 each include an inside surface, 22 and 32 respectively, and an outside surface, 24 and 34 respectively. Compressible elements 40 and 50 are coupled to the outside surface 24 of the first pad element 20. In the present embodiment, the compressible elements are attached to the pad elements using a non-electrically conducting adhesive, although other attachment methods known in the art may be used. Compressible elements 60 and 70 are coupled to the outside surface 34 of the second pad element 30. The inside surfaces 22 and 32 of the first and second pad elements 20 and 30 are aligned in parallel with and opposite to each other.

Figure 2:
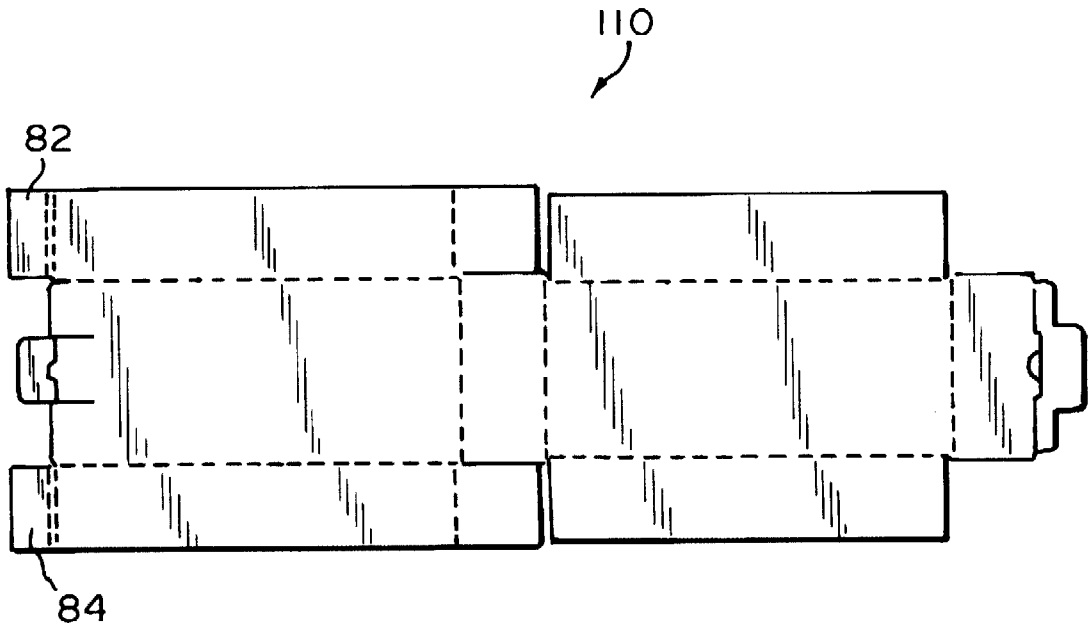
FIG. 2 is a top plan view of a primary blank used in the manufacture of the outer shell of the container illustrated in FIG. 1.

The pad elements 20 and 30 and the compressible elements 40, 50, 60 and 70 are placed inside of an outer shell 80. In the present embodiment, the outer shell 80 is a rectangular locking tab box comprising corrugated cardboard. A blank 110 used to manufacture outer shell 80 is illustrated in FIG. 2. Alternative embodiments may include outer shells including other materials known in the art, such as plastic or fiberboard.

The outer shell 80 includes two securing tabs 82 and 84 generally placed along the sides of the mouth of the container. When the pad and compressible elements are placed inside of outer shell 80, compressible pads 40 and 60 are secured by tabs 82 and 84 to impede movement along an outwardly (that is, opposite the direction of insertion of the board) longitudinal axis.

In the present embodiment, compressible elements 40, 50, 60 and 70 comprise antistatic foam, such as half-inch Future-Star 3000® Foam manufactured by Future Foam, Inc. of Council Bluffs, Iowa. Other antistatic foams having different densities and properties also may be used. In container 100, the thickness of the compressible elements 40, 50, 60 and 70 is such that when placed inside of the outer shell 80 the distance between the inner surfaces 22 and 32 of the pad elements 20 and 30 is less than the width of the board element 10. The compressible properties of the compressible elements 40, 50, 60, and 70 allow the adjustment of the spacing between the pad elements 20 and 30 to accommodate board components having different widths. In alternative embodiments, compressible element 40, 50, 60 and 70 may be replaced by two longitudinal pieces or by a single folded piece of a compressible material. In yet other alternative embodiments, the compressible elements may include a compressible device known in the art, such as a spring or coil.

Figure 3:
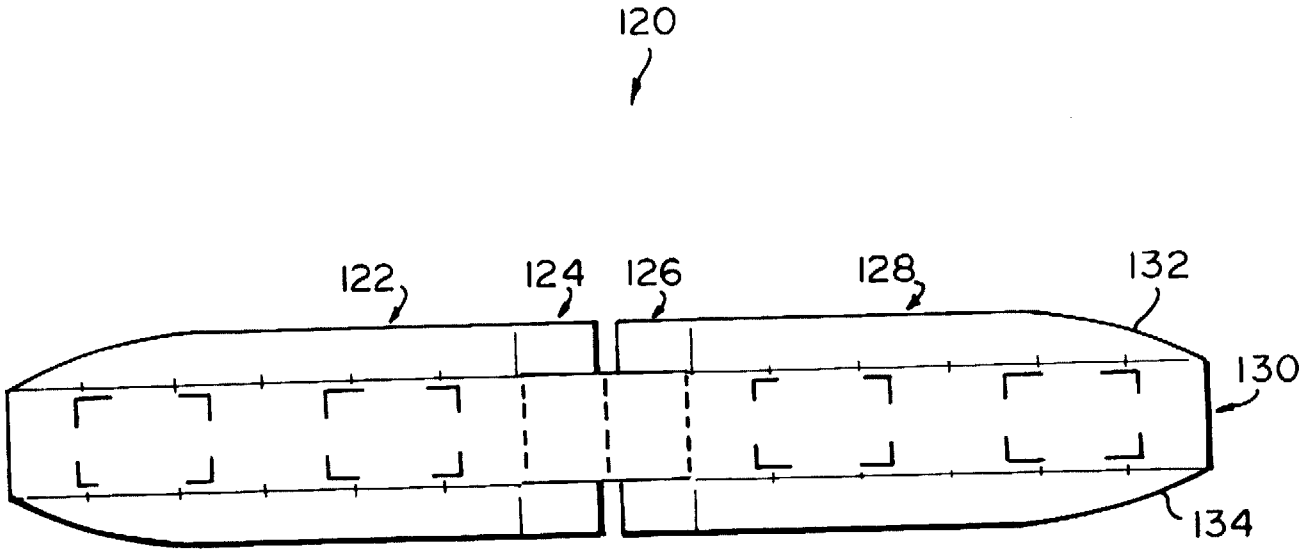
FIG. 3 is a top plan view of a blank used in the manufacture of the pad elements of the container illustrated in FIG. 1.

FIG. 3 illustrates a blank 120 used in the manufacture of pad elements 20 and 30. Both the blank 110 of FIG. 2 and the blank 120 of FIG. 3 comprise a generally planar cut and scored sheet of corrugated cardboard having an electrically dissipative coating, such as Centurian™ II Dissipative Coating manufactured by Century Container Corp. from Oak Brook, Ill. A dissipative coating includes materials that help prevent the buildup of static electrical charges and that help dissipate potentially damaging electrical charges. In the present embodiment, the dissipative coating is applied to the interior surfaces of blank 110 and to all major exposed surfaces of blank 120.

As can be appreciated in FIGS. 1 and 3, the blank 120 is cut into the two pad elements 20 and 30. The pad elements 20 and 30 are generally "L"-shaped, each having a longitudinal portion 122 and 128 respectively and a laterally-extending portion, 124 and 126 respectively. Portions 122 and 128 of blank 120 correspond to the longitudinal portions of pad elements 20 and 30, while portions 124 and 126 of blank 120 correspond to the lateral portions of pad elements 20 and 30. The pad elements 20 and 30 include a first outer layer and a second inner layer. The first outer layer of the pad elements 20 and 30 corresponds to a generally rectangular central portion 130 of the blank 120. The second inner layer corresponds to the winged portions 132 and 134 of blank 120, which are folded and secured over the inner portion 130, such as by using a non-electrically conducting adhesive. The second layer of the pad elements 20 and 30 includes a lower rail element 134 and an upper rail element 132. The rail elements 132 and 134 are separated from each other by a small gap, thereby defining longitudinal slots. The slots include a delta-shaped or laterally flaring receiving end portion to facilitate insertion of the board component 10. The receiving end portion of the slots is defined by the tapered proximal end portions of the wings/rails 132 and 134. The longitudinal slots in blank 120 are generally perpendicular to the corrugation channels of the corrugated cardboard blank 120.

The container of the present invention may be utilized both during the assembly process of the board component and/or during the shipment the board component. The term shipping is intended to include the packaging, transport and/or presentation of the board component.

During use, a container in accordance with the present invention is first provided and placed on an assembly line having at least one work station. It is to be understood that the term assembly line is meant to include a sequential fabrication process, whether or not connected by a conveyor or other similar device.

The board component 10 is inserted into the container 100 along the longitudinal slots. When inserting the board component into the container, the compressible elements are compressed to accommodate boards of different widths. Similarly, the compressible memory of the compressible elements exerts lateral forces against the board component, securing it in its position inside of container 100. The board component 10 is transported inside of the container 100 to a work station, where the worker or a machine removes the board 10 from the container 100 and performs a task on the board, such as adding or testing electrical components, soldering, printing circuit connectors or other processes related to the manufacture of the board component. The board component is then returned to (i.e., slid back into the container) 100 after the work is performed. In alternative embodiments, the container 100 may include access openings or panels that allow work to be performed on the board component without removing it from the container 100. In yet other embodiments of the present method, the board component may remain secured in the pad elements while work is being performed and both the board component and the pad elements and/or the compressible elements would be reinserted into the outer shell when the component is to be transported to another work station or is to be packaged.

After work is completed on the board component and/or when the board component is ready to transport to another location, the board component 10 may be shipped inside of container 100. Use of the same container for both assembly and packaging eliminates the need for additional handling, for a separate packaging station, and for separate packaging materials.

The present invention allows the use of a single container for both the assembly and the packaging/shipping of a board component. The board component is protected from static electrical charges and against drop or impact damage. The range of compression of the compressible elements allows the container of the present invention to be used with a variety of board elements of different sizes, thus reducing the need for different sized boxes for each particular board component. Finally, the container of the present invention is lightweight, cost efficient, suitable for receiving consumer-oriented graphics or displays and is generally recyclable.

Many modifications and variations may be made in the techniques and structures and illustrated herein without departing from the spirit and scope of the present invention. Accordingly, it should be understood that the methods and apparatus described herein are illustrative only and are not limiting in the scope of the present invention.

What is claimed is:

1. A method of using an assembly line and shipping container, the method comprising the steps of:

providing a container comprising:

an outer shell, a first pad element and a second pad element, the pad elements having an inside surface and an outside surface, a first compressible element coupled to the outside surface of the first pad element and a second compressible element coupled to the outside surface of the second pad element, and wherein the inside surfaces of the pad elements are oppositely aligned with respect to each other inside the outer shell, the first and second pad elements including a first and a second longitudinal slot respectively, the slots aligned opposite each other, placing the container on an assembly line having at least one work station;

inserting a board component into the container along the longitudinal slots;

removing the board component from the container at the work station;

reinserting the board component into the container; and shipping the board component inside the container.

2. The method of claim 1, wherein the step of inserting the board component into the container includes the step of compressing the compressible elements to accommodate the width of the board.

3. The method of claim 1, the pad elements comprising a coating of a dissipative material.

4. The method of claim 1, the compressible elements comprising at least two separate pieces of antistatic foam.

5. The method of claim 1, the first pad element comprising a panel of corrugated cardboard having a longitudinal section and a lateral section foldably connected to each other, the panel of corrugated cardboard having a plurality of corrugation channels having an orientation generally perpendicular to the longitudinal slot.

6. The method of claim 1, the outer shell comprising a corrugated cardboard box having inner surfaces coated with a dissipative material.

7. An assembly line and packaging assemblage for a board component comprising:

an outer shell, a first pad element and a second pad element oppositely aligned with respect to each other inside the outer shell, each pad element having an inside surface and an outside surface, the first and second pad elements including a first and a second longitudinal slot respectively, the slots aligned opposite each other;

a first compressible element coupled to the outside surface of the first pad element; and a second compressible element coupled to the outside surface of the second pad element.

8. The assemblage of claim 7, wherein when the compressible elements are uncompressed, the inside surfaces of the first and the second pad elements are separated a distance smaller than the width of the board component.

9. The assemblage of claim 7, the first pad element comprising a first panel of corrugated cardboard and a second panel of corrugated cardboard coupled to the inside surface of the first panel, the second panel including a lower rail element and an upper rail element, the rail elements defining the longitudinal slots, the slots having a delta-shaped receiving end portion.

10. The assemblage of claim 7, the pad elements comprising a panel of corrugated cardboard having a longitudinal portion and a lateral portion, wherein the panel of corrugated cardboard includes a plurality of corrugation channels having an orientation generally perpendicular to the longitudinal slots.

11. The assemblage of claim 7, the pad elements comprising a coating of a dissipative material.

12. The assemblage of claim 7, the compressible elements comprising two separate pieces of antistatic foam.

13. The assemblage of claim 7, the outer shell comprising a rectangular corrugated cardboard box having inner surfaces coated with a dissipative material.

14. The assemblage of claim 7, the outer shell comprising a rectangular corrugated cardboard box having retaining folds at a receiving end, wherein the folds retain the compressible elements along an outward longitudinal axis of movement.

* * * * *